United States Patent [19]

Jansing et al.

[11] 4,446,820

[45] May 8, 1984

[54] STEAM GENERATOR HEATED BY LIQUID METAL

[75] Inventors: Walter Jansing, Bergisch-Gladbach; Kurt Vinzens, Overath-Immekeppel, both of Fed. Rep. of Germany

[73] Assignee: INTERATOM Internationale Atomreaktorbau GmbH, Bergisch-Gladbach, Fed. Rep. of Germany

[21] Appl. No.: 241,833

[22] PCT Filed: Nov. 23, 1979

[86] PCT No.: PCT/EP79/00093

§ 371 Date: Jul. 28, 1980

§ 102(e) Date: Jul. 28, 1980

[87] PCT Pub. No.: WO80/01101

PCT Pub. Date: May 29, 1980

[30] Foreign Application Priority Data

Nov. 27, 1978 [DE] Fed. Rep. of Germany ..... 2851197

[51] Int. Cl.[3] ..... F22B 1/02; F22B 37/24

[52] U.S. Cl. ..... 122/32; 122/6 A; 122/235 A; 122/510

[58] Field of Search ..... 122/510, 511, 32, 6 A, 122/235 A, 235 J, 235 K

[56] References Cited

U.S. PATENT DOCUMENTS

| | | | |
|---|---|---|---|
| 3,868,927 | 3/1975 | Losel et al. | 122/6 A |
| 4,063,534 | 12/1977 | Kral | 122/510 |
| 4,116,168 | 9/1978 | Gorzegno et al. | 122/510 |
| 4,148,281 | 4/1979 | Stoll et al. | 122/32 |
| 4,284,134 | 8/1981 | Harris | 122/32 |
| 4,290,388 | 9/1981 | Ruhe et al. | 122/235 A |
| 4,307,685 | 12/1981 | Robin et al. | 122/32 |
| 4,337,827 | 7/1982 | Jabsen | 122/510 |
| 4,357,907 | 11/1982 | Campbell, Jr. et al. | 122/510 |

*Primary Examiner*—Henry C. Yuen

*Attorney, Agent, or Firm*—Herbert L. Lerner; Laurence A. Greenberg

[57] ABSTRACT

Steam generator, preferably for use in nuclear energy plants, which comprises several coiled tube bundles (5) which are arranged in series and disposed in a common container (1), in which steam is generated and superheated thereafter. The individual tube bundles are separated from each other by interspaces (16) in which straight connecting tubes are arranged. Points which require inspection, and are possibly in danger of springing leaks, for example, the welded connections between the individual tube lengths, are positioned in these interspaces for easier accessibility. Furthermore in the same container are also tube bundles (21) arranged in which the steam is superheated. In the middle of the container a central tube (4) is arranged, in which the feedwater supply (6) is conducted, and which in operation closed by a blow-out disc (15), and which, if necessary can discharge the products of a liquid metal-water reaction. Special configurations of the feedwater distributors (8–11) are proposed, which enhance the safety of the steam generator in the case of malfunctions, for example, absorb the reaction forces of torn tube lines. Furthermore embodiments of the steam-collectors (27) are proposed which facilitate the inspection of the tube bundles.

7 Claims, 6 Drawing Figures

STEAM GENERATOR HEATED BY LIQUID METAL

Figure 1:
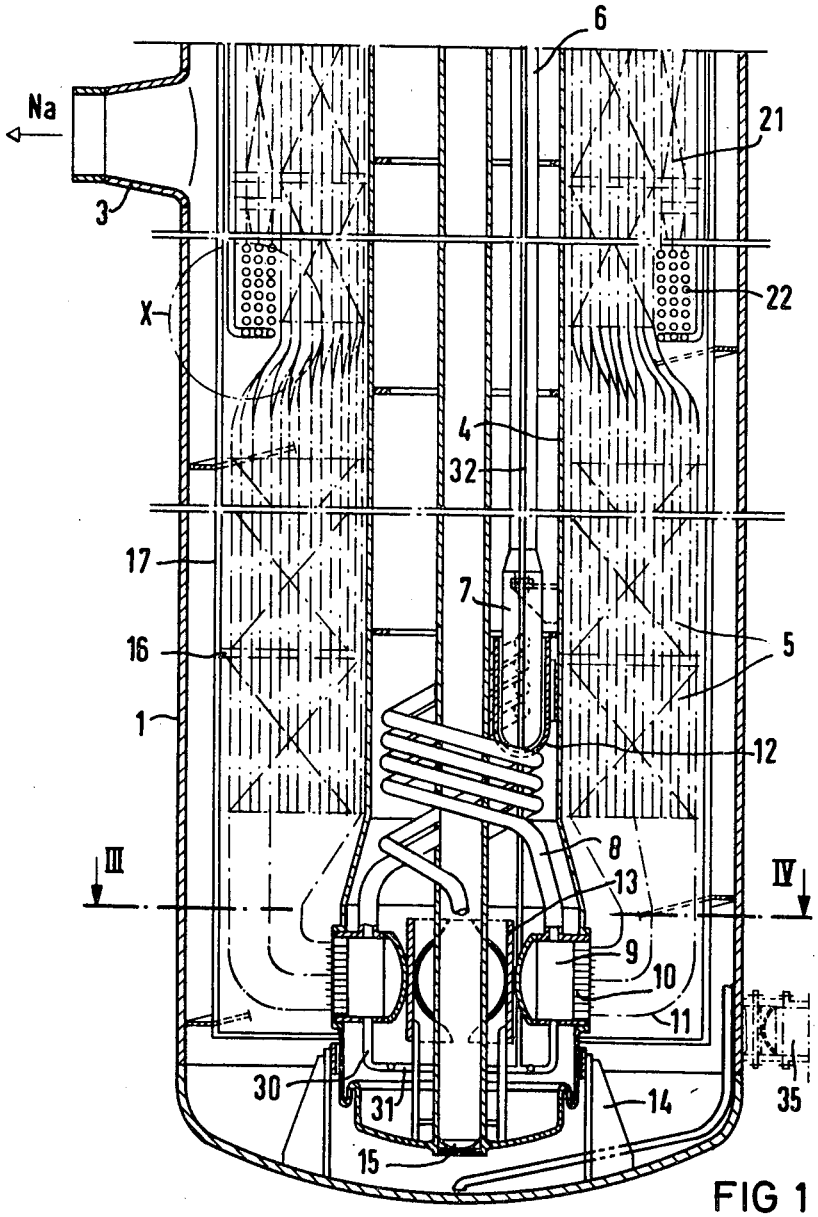

The invention relates to a helical tube steam generator heated by liquid metal, including a central pipe being closed at a lower end and being disposed in a container, one or more down pipes for feedwater disposed in the central tube, a shell, and helical tube bundles surrounded by the shell.

To increase the degree of total effectiveness of steam power installations, it is advantageous to again superheat the already expanded and cooled steam in the high and medium pressure portion of a steam turbine. In nuclear reactors which are cooled with liquid metal, for example sodium, which have considerably higher requirements with respect to safety and reliability than conventionally heated steam power plants, this intermediate superheating was either avoided, or built into separate structures which run parallel to the superheaters on the side of the hot liquid metal. Nuclear reactor plants which often produce considerably more power than conventionally heated installations, must not only generate current with high availability and a high degree of total effectiveness; in the case of a malfunction, which is after all possible, the heat generated by the nuclear reactor must be conducted away in a manner so that the nuclear reactor does not exceed the operating temperatures for which it is by much. For this reason, up to now, the efforts were directed to separate apparatus of different kinds, such as, for example, superheater and intermediate superheater, so that they do not influence each other disadvantageously in case of a malfunction, and can be operated independently of each other. But this separate construction leads especially in liquid metal cooled nuclear energy plants to considerable expenditures for tube lines, insulation, and safety devices, even when disregarding the additional space requirement which especially is connected with high costs in nuclear energy plants.

A liquid metal/ water-heat exchanger used as a steam generator for nuclear energy plants is already described in the German Published, Non-prosecuted Application DE-OS No. 24 48 832. Several vertical tube bundles, each surrounded by a jacket which is open at the top and bottom, are arranged in a container so that they can be exchanged from the top. Because the hot liquid metal is conducted in counterflow to the water or the steam, a compact arrangement is already achieved thereby, wherein the individual tube bundles in case of damage, can be quickly exchanged with low cost. However, the intermediate superheating of the steam with hot liquid metal is not provided in this arrangement.

The invention has the objective to construct a steam generator-heated by liquid metal which is more economical than the present ones. This economy is to be achieved by:

(1) with respect to the thermal effectiveness of the steam plant by intermediate superheating of the steam with hot liquid metal, (2) with respect to the costs of the installation by integrating the intermediate superheater into the already existing steam generator-container, (3) with respect to the operating costs by facilitating inspection and repair, and by redundant suspension of the steam-generating bundles.

To achieve this objective, there is provided a steam generator wherein a plurality of tube bundles are disposed on top of each other, with horizontal spaces inbetween the tube bundles wherein only tubes are located, and besides one or more tube bundles with steam generating and/or superheating tubes, there are provided additional tube bundles containing intermediate superheater tubes. It was conventional up to now to construct steam generators which are heated by liquid metal as compactly as possible, and without large interspaces between heating surfaces of different kinds, because the volume of these containers firstly directly influences their price, and secondly the increase of the liquid metal volume also raises the price of the whole installation, including the ancillary installations. However, deviating from this principle, the horizontal interspaces between individual tube bundles of different or equal type, though they occupy valuable space, have considerable advantages for the operation, inspection and repair of the heat exchangers.

Within these interspaces those structural parts are arranged which:

(1) must be examined and monitored at regular intervals, (2) which are necessary for checking the other structural parts, and (3) those which could pose a danger for the other structural parts. Thus, in these interspaces the welding seams are located, which necessarily are present at long heat exchanger tubes, arranged with considerable distances from other structural parts. It has been shown that the possible damages in liquid-metal-water-heat exchangers occur almost exclusively at the unavoidable welding seams of the heat exchanger tubes. If these welding seams are intentionally positioned in the interspaces between the individual tube bundles, they can more easily be checked there than in a narrow tube bundle, and repaired, if required. Furthermore, the arrangement of the welding seams in a free interspace with spacing from the other structural parts, has another important advantage for the operation of the whole plant. Furthermore, the smallest leaks in a water- or steam containing tube, within a container of liquid metal leads after a short time to substantial damage, according to general experience, because the water vapor escaping under pressure becomes a flame in the liquid metal, and results in high, locally concentrated temperatures because of the chemical reaction between water and the liquid metal. Together with the high velocity of the steam which escapes under high pressure, adjacent parts are quickly destroyed by these flame like phenomena.

By the arrangement according to the invention of horizontal interspaces between the tube bundles, and the arrangement of all welding seams in these interspaces, one can assure with great reliability that no damages will occur in the tube bundles themselves. Under these conditions it becomes possible to arrange in the same container not only the evaporator- and superheater, but also the intermediate superheater tube bundle, because no interacting malfunctions are to be expected here.

In accordance with the invention brackets are disposed in the interspaces between the tube bundles having the following features: the coiled tube bundle lying beneath it, is suspended at the brackets, and the brackets carry the coiled tube bundle lying above it in case the suspension above it fails. The steam generator provides two additional advantages with respect to operation and monitoring. In contrast to the up-to-now known constructions of suspending the whole tube bundle of the heat exchanger at the upper end of the container, the proposed arrangement of several support-structures between the individual tube bundles, first of all, assures that each support structure is under considerably less load, because it carries only a part of the whole tube bundle. By the proposed double function of a support structure, i.e. to normally carry the tube bundle lying beneath it, and in the case of a failure of the support structure above it to support also the tube bundle above it, the reliability of the whole construction is increased.

In accordance with the invention, there are provided several distributor tube lines on top of each other connected at the lower end of the feedwater-fall pipe, the distributor tube lines being helically disposed within each other, the other ends of the distributor tube lines ending in secondary distributors for the coiled tube bundles, and the secondary distributors being arranged around the circumference. The distributor construction on one hand avoids unpermissible stresses by the different expansion of fall-pipe and central tube with respect to the tube plate, and on the other hand, effects the uniform flow around all coiled tubes distributed over the circumference of the container. Furthermore, the middle of the central tube is kept open for remote controlled inspection-and repair apparatus by the eccentric arrangement of the single fall pipe and by the screw-like form of the distributor tubes.

In accordance with the invention there are also provided several cylindrical secondary distributors arranged around the circumference having outwardly turned tube plates for the coiled tubes, and inwardly turned rounded bottoms with the following features: a support structure is disposed between the rounded bottoms of the secondary distributors, and the support structure is only a small distance away from the rounded bottoms of the secondary distributors. The arrangement fulfills two opposing requirements. On one hand, the secondary distributors should be accessible for remote controlled inspection and repair apparatus; on the other hand, the secondary distributors which are uniformly arranged around the circumference are designed to support each other at a possible failure of one of them, so that no secondary damages can occur at other structural parts. The support structure according to the invention which is arranged with a short distance from the bottoms of the secondary distributors is open on top and bottom, and thereby easily accessible for tools. Furthermore, it can be removed upward with simple means, and in some case also toward the bottom.

In accordance with the invention, the lower end of the feedwater down pipe is surrounded at a very small spacing by a double tube which is closed at its lower end, and this double tube is fastened at the inner surface of the central tube. The arrangement also has the purpose of avoiding serious damages resulting from the damage of the fall pipe. The proposed double tube is intended to hold the lower end of this fall pipe if it should start to move because of the reaction forces acting on its bottom, or due to a completely severed distributor tube.

In accordance with the invention, the coiled tubes end in the tube plates of collectors with the following features: the distributor or the collector has a rotation-symmetrical form with respect to the adjacent collecting line, and the tube floor or plate is part of a surface of a sphere. The collector should combine numerous coiled tubes. Since these long twisted tubes must be checked with long, flexible probes from the inside at regular intervals, the coil-tubes must be accessible with a manipulating device. To make it possible for such a device to reach all tube ends from one point in the direction of the tube axis, it is proposed, according to the invention, not to weld these tube ends into a tube plate, as done conventionally but to weld them into a part of a spherical surface. In this manner, one can only reach all tube ends by rotation of suitable manipulating means, which are located on a circular path, and by changing the angle between the manipulating means and the collector axis one can always reach the adjacent circle of tube ends.

In accordance with the invention, the central tube is slideably supported in the vertical direction in centering means disposed at the bottom of the container. The arrangement proposes a construction which avoids impermissible thermal tensions by the different expansion of the container and the central tube, but a construction which still permits a simple removal of the central tube with the coiled tubes attached to it toward the top, and which protects the lower end of the central tube against impermissible horizontal loads, for example, during an earthquake.

In accordance with the invention, each secondary distributor is provided with a drain line, and the drain lines are individually conducted upward in the central tube or in combination. During repair operations, by applying low pressure to the coiled tubes, the construction permits the complete removal of water from the latter, and also from the secondary distributors which are located at the lowest point.

Figure 2:
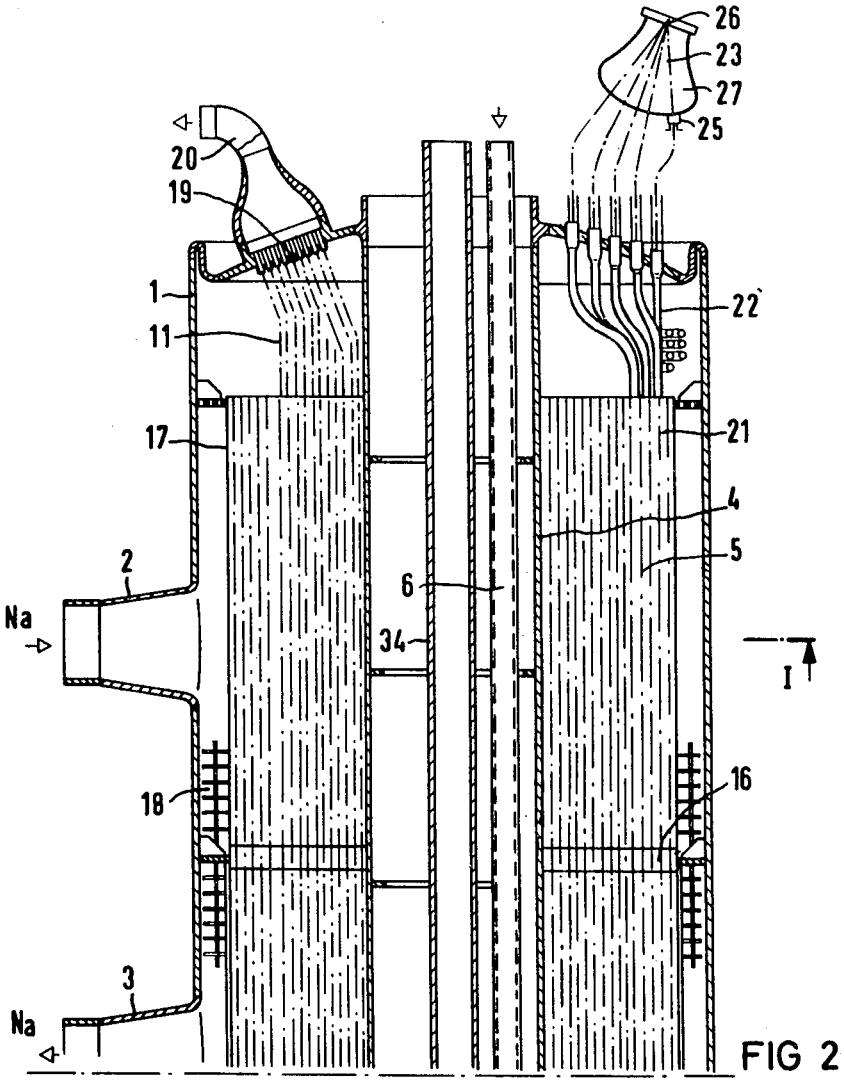
Figure 3:
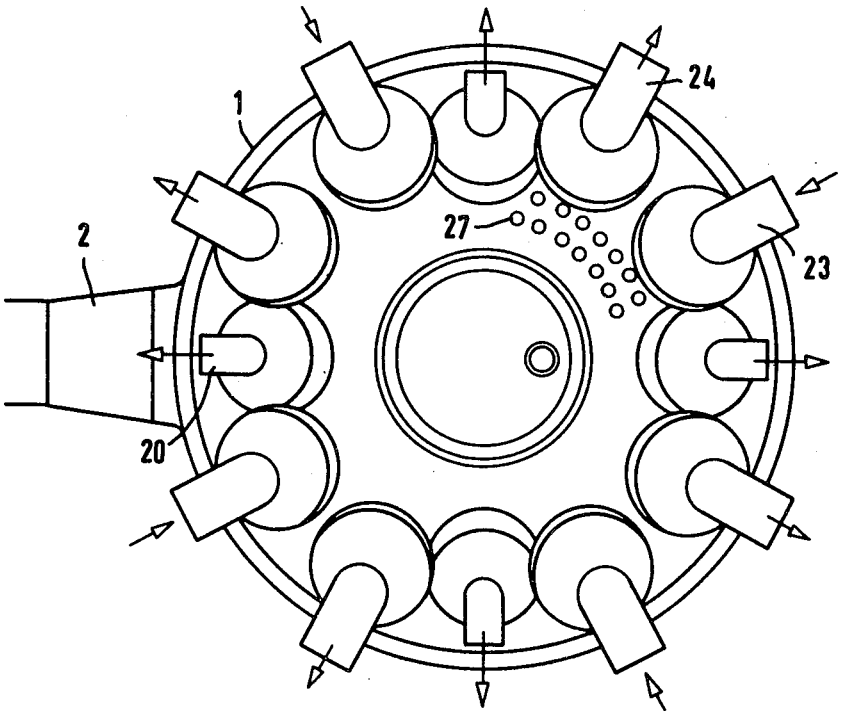
Figure 4:
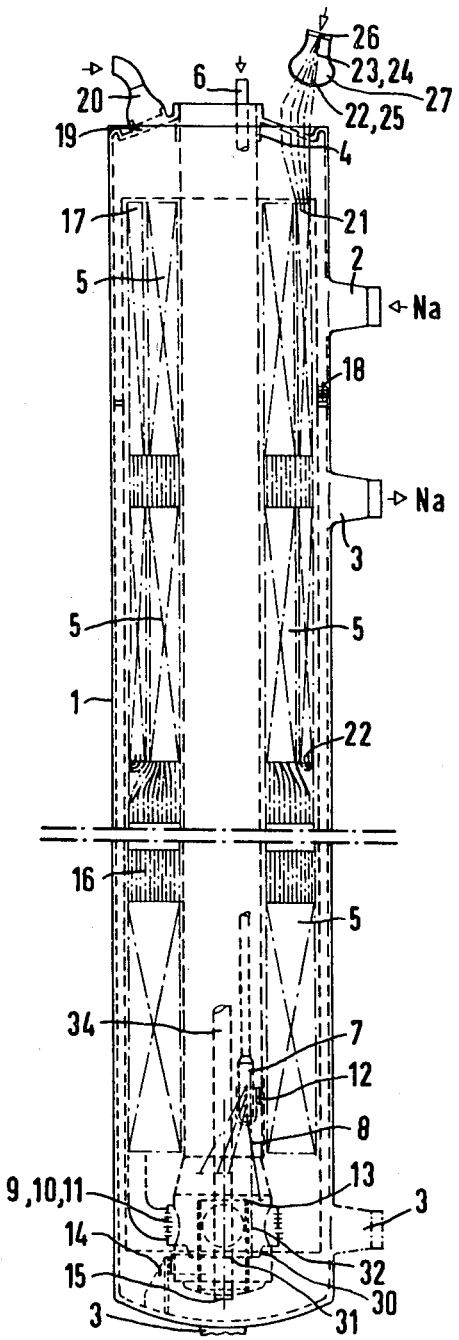
Figure 5:
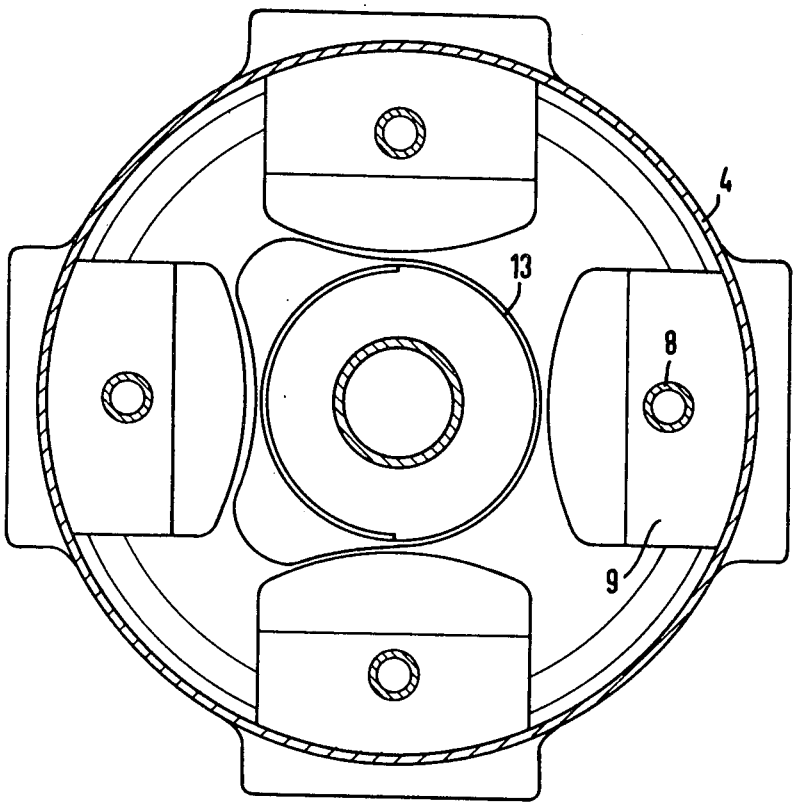
Figure 6:
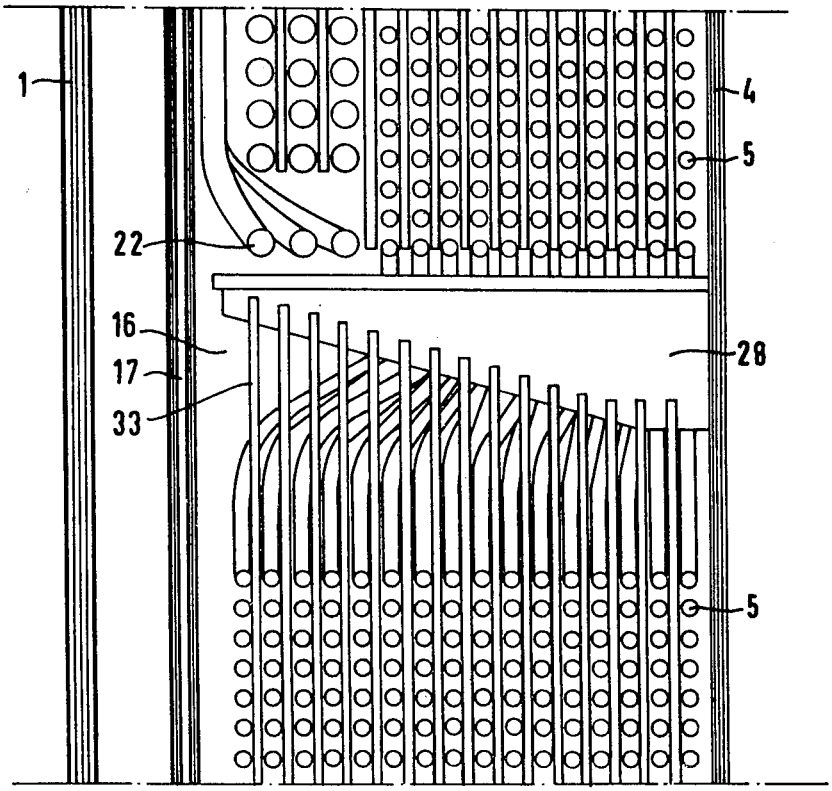

FIGS. 1 to 4 show a possible, typical embodiment of the invention, wherein FIG. 1 shows the lower part of a longitudinal section through a steam generator, FIG. 2 shows the upper part of a longitudinal section through the steam generator, FIG. 3 shows a plan view of the latter, FIG. 4 shows another longitudinal section in a smaller scale, FIG. 5 shows a section corresponding to line III–IV of FIG. 1, in enlarged scale, and FIG. 6 shows the detail X of FIG. 1, in enlarged scale.

The steam generator is arranged in a container 1 through which the flow of the liquid secondary-sodium is conducted, which is heated in a non-illustrated sodium/sodium-intermediate heat-exchanger by the primary sodium, which is used as coolant for the nuclear reactor, and which enters through a short tube 2 and leaves the container through a tube 3. A central tube 4 which is closed at the bottom, is arranged in the interior of the container 1, and between the two, a number of heat exchange tubes are disposed, and combined to from bundles 5, of which, in a known manner, the lower ones are used for steam generating, and the upper ones for superheating, and which each occupy a sector of the space in between. The feed water is introduced through a down or fall-pipe 6 which is arranged in the interior of the central tube 4 which is filled with air, or an inert gas, whereby the danger of a reaction between water and sodium in case of leakage from the fall-pipe is eliminated. The fall-pipe 6 ends in a distributor 7, from which, in the embodiment, four pipelines or distributors 8 which are coiled to equalize heat expansions, lead to secondary distributors 9 with an approximately semi-spherical bottom and a tube-plate 10, into which the steam generating tubes 11 are welded. Upon the occurrence of a possible rupture of one of the pipelines 8 of the distributor 7, the generated reaction forces are absorbed by the double-tube 12 which surrounds the latter. In the case of similar damages at the secondary distributors 9, the latter are braced by an extensible structure 13 which fills the empty spaces between the secondary distributors, whereby this structure in the plan view is arranged approximately star-shaped (left half of FIG. 5) or circular (right half of FIG. 5). From the secondary distributors 9, drainlines 30 with cut-off means lead to a ring-shaped collecting line 31. Through a further line 32 which is disposed in the central tube 4 all tube bundles 5 can be emptied of water. At its lower end the central tube 4 is floatingly (slidingly) supported in centering means 14 which are fastened to the container 1; furthermore, it is provided with an opening which in operation is closed by a blow-out disc 15, through which the over-pressure occurring at a sodium-water reaction in the steam generator is reduced, and the reaction products can pass through the central tube 4 to a separator which is not shown in the drawings. Alternatively to this, a pipe 35 (shown dotted) can be provided which is also closed by a blow-out disc, when a discharge of the reaction products into the deactivated space of the steam generator is possible. The individual tube bundles 5 are, according to height, separated by short portions 16 in which the tubes run straight, thereby permitting better conditions for inspection and possible repairs; the required welding joints between the individual sections of the tubes 11 are located in these portions. A jacket shell 17 with thermal insulation is arranged between the tube bundles 5 and the wall of the container 1, which serves for protection of the tube bundles from the flame occurring at a sodium-water reaction, and also serves as a flow guide. For repair purposes, the tube bundles 5, together with the shell 17 can be removed from the container upward (after disconnecting the connections to the tube plate 10), and also the fall-pipe 6, the distributor 7, tubelines 8 and the secondary distributor 9 can be removed through the central tube 4.

In the upper part of the container 1 (see FIG. 2), between the latter and the jacket-shell 17, a cell-like structure 18 is arranged, which by its cell-like construction inhibits convection, and reduces the temperature differences between the inward and outward flowing sodium. This can be omitted if the sodium inlet and outlet-port are locatedsufficiently far apart, as shown in FIG. 4 with the alternate position of the exit tube 3 shown in broken lines. At the upper end of the heat exchanger, the superheat-tubes end in additional tubeplates 19 from which a steam line 20 always originates. In the superheat zone, the tube bundles 5 are constructed with increased spacing, so that space is provided at their outside for additional tube bundles 21 which are constructed of additional tubes in which the intermediate superheating of the steam takes place. Obviously, if necessary, the intermediate superheater tube bundles 21 can also extend over the entire height of the steam generator. They are so designed that the sodium temperatures in these bundles is as nearly as possible the same as the temperature existing in the steam-generator/superheat bundles located at the same height. The live steam line is designated by reference numeral 23, the dead steam line is designated by reference numeral 24. Both end in a tube-floor 25 in a distributor or collector 27, which is part of a spherical surface, so that a non-illustrated probe which may be attached approximately at point 26, can be easily attached and with a minimum of motion be inserted into the individual tubes 22.

The individual tube bundles 5, 21, respectively, are mounted in a known manner on rods 33 of brackets 28 at the jacket-shell 17. The brackets 28 are so constructed that if the rods 33 of one tube bundle break, the latter is supported on the next lower bracket. (See FIG. 6).

We claim:

1. Helical tube steam generator heated by liquid metal, comprising a container, a central pipe being disposed in said container and having a closed lower end, at least one down pipe being disposed in said central pipe for feed water and having a lower end, a shell disposed between said container and said central pipe, a plurality of groups of helical tubes disposed one above the other in said shell defining horizontal interspaces between said groups of helical tubes in which said tubes are extended in a straight line, further groups of intermediate superheating tubes disposed in said shell, a plurality of distributing pipes being disposed one above the other and being helically disposed within each other, said distributing pipes having first ends connected to the lower end of said feed water down pipe and second ends, and peripherally spaced apart secondary distributors for said groups of helical pipes being connected to said second ends of said distributing pipes.

2. Steam generator according to claim 1, including brackets disposed in said interspaces between said groups of helical tubes, and respective means for suspending said groups of helical tubes from each of said brackets, whereby if one of said suspending means fails, said groups of helical tubes are supported on underlying brackets.

3. Steam generator according to claim 1, wherein said peripherally spaced apart secondary distributors include outwardly-directed tube plates for said helical tubes and inwardly-directed rounded plates, and including a supporting structure for said secondary distributors being disposed between and in vicinity of said rounded plates.

4. Steam generator according to claim 3, including a double pipe surrounding said feed water down pipe at a distance defining a gap therebetween, said double pipe being secured to the inner periphery of said central pipe and having a closed lower end.

5. Steam generator according to claim 1, including a collecting pipeline, collectors connected to said collecting pipeline and having tube plates into which said helical tubes discharge, said collectors being radially symmetrically disposed relative to said collecting pipeline, and said tube plates being parts of spherical surfaces.

6. Steam generator according to claim 1, wherein said container has a base, and including centering means disposed at said base of said container, and said central pipe having a lower end being vertically slideable in said centering means.

7. Steam generator according to claim 3, wherein said secondary distributors each include a discharge pipe extended upward in said central pipe.

* * * * *